United States Patent [19]

Arnold

[11] Patent Number: 4,583,725

[45] Date of Patent: Apr. 22, 1986

[54] PATIENT SUPPORT FRAME FOR POSTERIOR LUMBAR LAMINECTOMY

[76] Inventor: Roger D. Arnold, 4259 Macon Rd., Memphis, Tenn. 38122

[21] Appl. No.: 708,403

[22] Filed: Mar. 5, 1985

[51] Int. Cl.[4] ..... A61G 13/00

[52] U.S. Cl. ..... 269/328

[58] Field of Search ..... 269/322-328; 5/431, 437

[56] References Cited

U.S. PATENT DOCUMENTS

| | | | |
|---|---|---|---|
| 2,452,816 | 11/1948 | Wagner | 269/328 |
| 3,381,684 | 5/1968 | Anderson | 269/328 |
| 3,873,081 | 3/1975 | Smith | 269/328 |

FOREIGN PATENT DOCUMENTS

| | | | |
|---|---|---|---|
| 1119944 | 6/1956 | France | 269/328 |

*Primary Examiner*—Robert C. Watson

*Attorney, Agent, or Firm*—John J. Mulrooney

[57] ABSTRACT

A patient support frame for use on an operating table during posterior lumbar laminectomy surgery comprises a frame for attachment to said table and a pair of iliac crest supports slidably mounted on said frame. The iliac crest supports are adjustable to engage the iliacs, or hipbones, of the patient whereby the prone patient is supported so that the abdomen does not touch the table and is substantially without pressure thereon.

2 Claims, 5 Drawing Figures

PATIENT SUPPORT FRAME FOR POSTERIOR LUMBAR LAMINECTOMY

BACKGROUND OF THE INVENTION

1. Field of the Invention

The present invention relates to surgical apparatus and, more particularly, to a patient support frame attachable to an operating table.

2. Description of the Prior Art

Surgical and osteopathic apparatus useful to support, or rock, or apply pressure to a patient's body is known. See U.S. Pat. Nos. 1,398,150, 1,479,166 and 1,984,520. However, none of the prior art apparatus is adapted to relieve pressure on a specific body area during a surgical procedure for the purpose of eliminating or greatly reducing bleeding. Specifically, the prior art does not disclose a patient support frame useful during posterior lumbar laminectomy procedures, particularly posterior lumbar interbody fusion, to support a prone patient in such a way that the abdomen does not contact the support table, thereby eliminating or substantially reducing bleeding from epidural veins during such procedures.

Accordingly, it is an object of the present invention to provide a patient support frame which will eliminate or substantially reduce bleeding during posterior lumbar laminectomy surgical procedures.

A further object of the invention is to provide a patient support frame useful during posterior lumbar laminectomy surgical procedures to support a prone patient in such a way that the patient's abdomen does not touch the supporting table, thereby eliminating or substantially reducing the bleeding which normally occurs during such procedures.

SUMMARY OF THE INVENTION

The present invention provides a patient support frame attachable to a surgical table and useful to eliminate or substantially reduce bleeding which occurs during posterior lumbar laminectomy surgical procedures. In brief, the patient support frame according to the present invention comprises a slidebar support member removably attachable to the table by brackets. The sidebar support member is selectively adjustable to a desired height above the table. A pair of iliac crest, or hipbone, supports are slidably mounted on said slidebar support and are adapted to engage the patient's hipbones and to maintain the patient's abdomen off the operating table and without any pressure on the abdomen caused by the operating table.

DESCRIPTION OF THE PREFERRED EMBODIMENT

Figure 1:
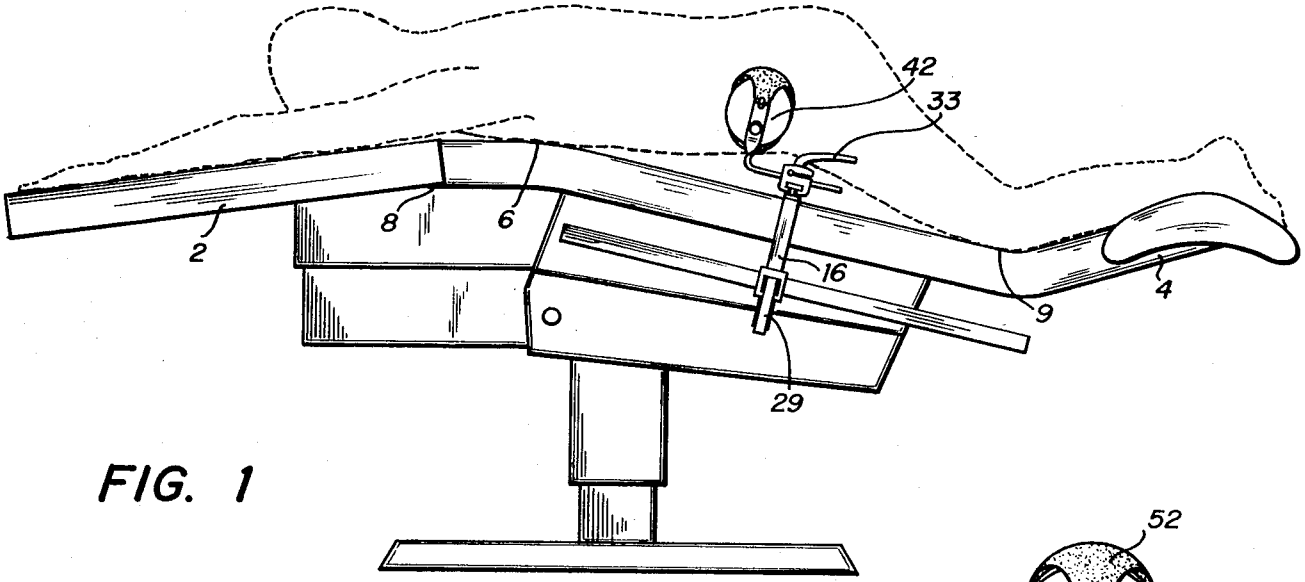
FIG. 1 is a perspective view of the patient support frame according to the present invention as it appears mounted on an operating table.
Figure 3:
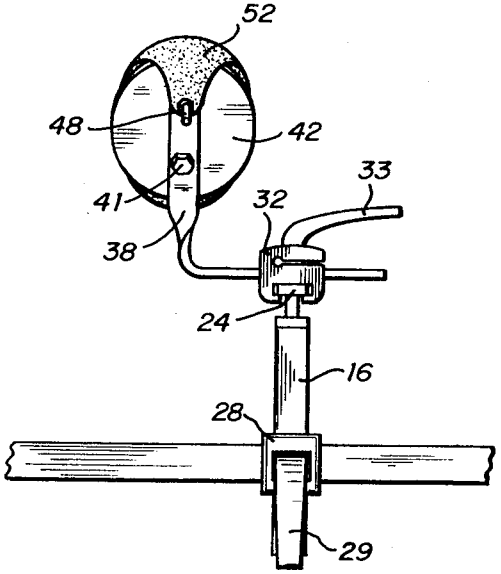
FIG. 3 is an end view of the patient support frame.
Figure 2:
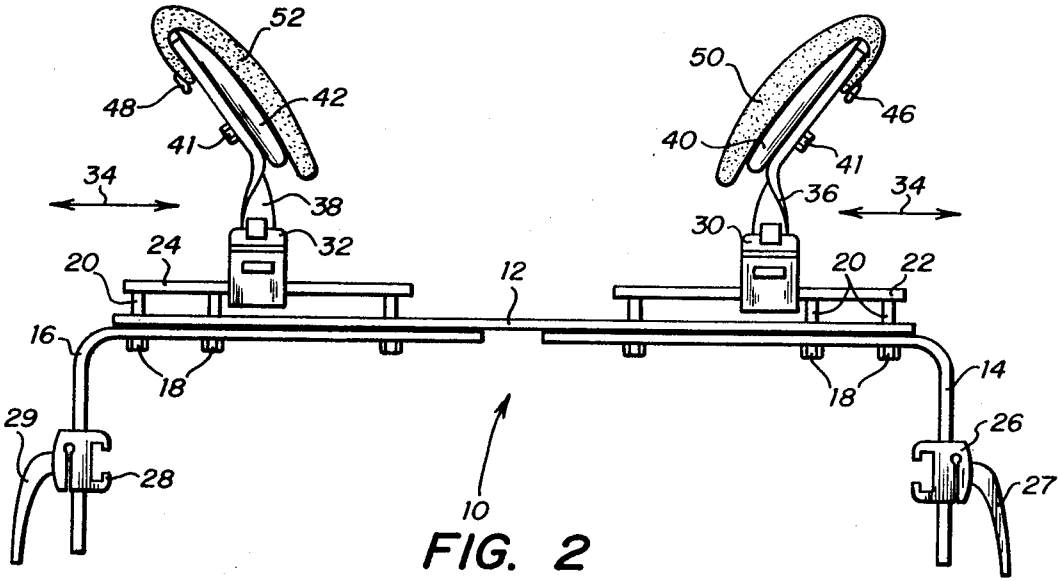
FIG. 2 is a front elevational view of the patient support frame.
Figure 5:
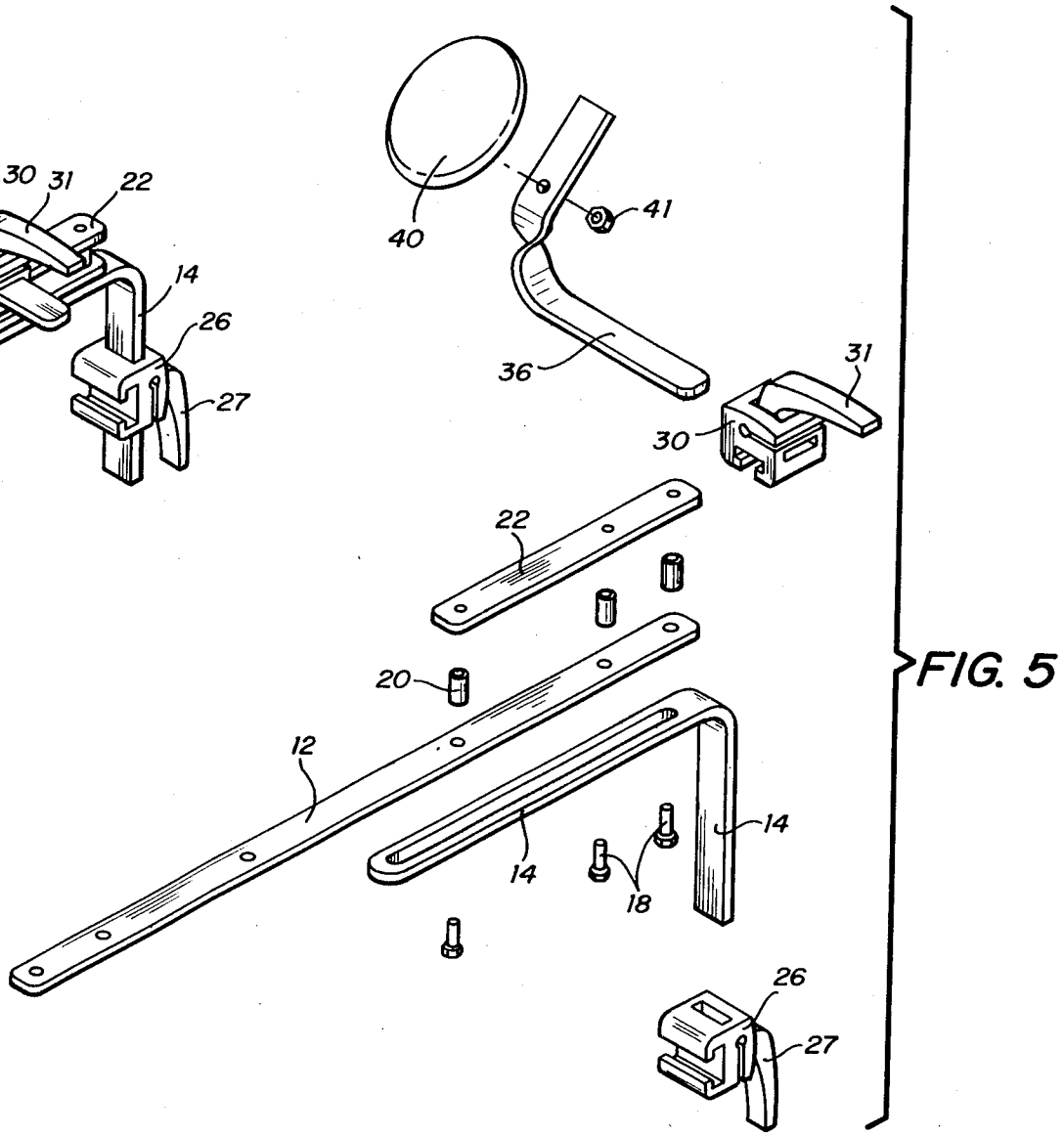
FIG. 5 is an expanded assembly of the component parts of one side of the patient support frame.
Figure 4:
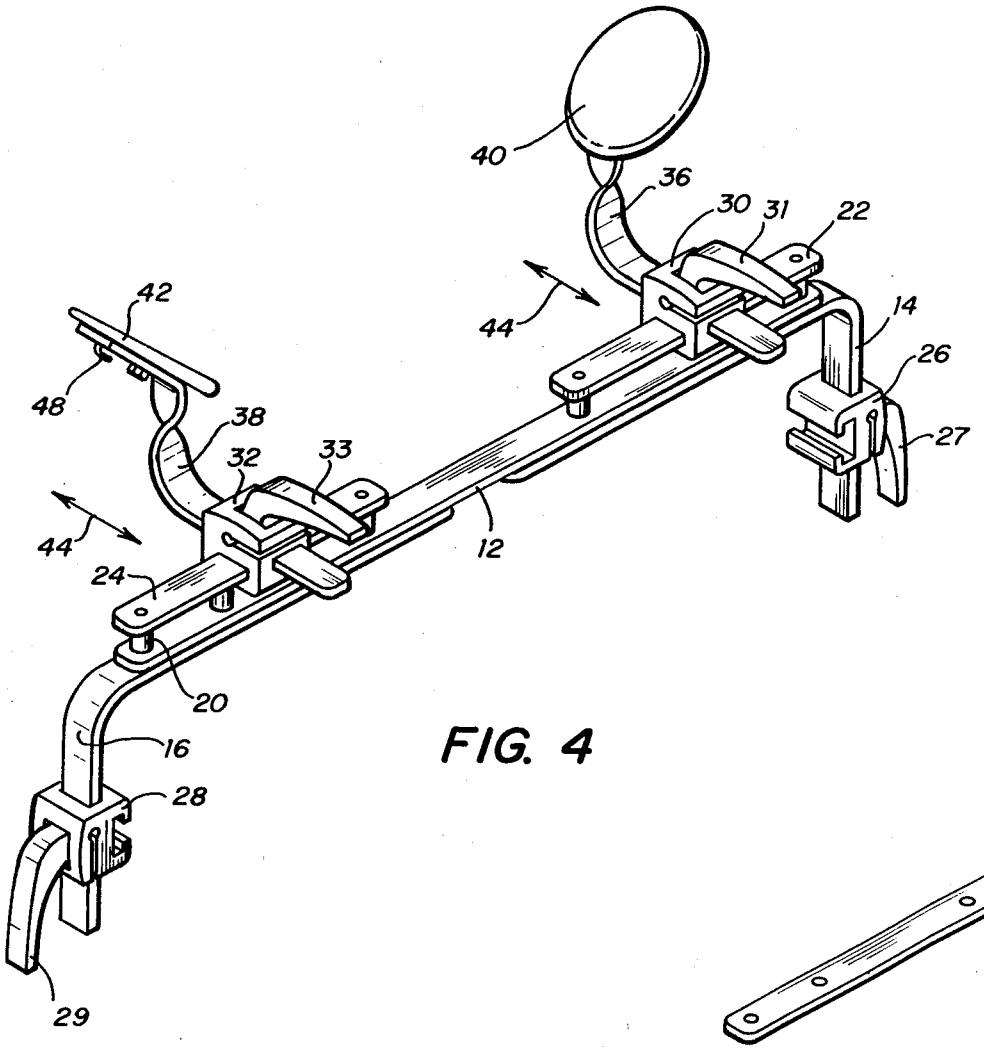
FIG. 4 is an isometric view of the patient support frame.

Referring now to the drawings, a patient support frame 10 according to the present invention may be considered as comprising a slidebar support 12, first 14 and second 16 adjustable table brackets positioned at each end of said slidebar support by bolts 18 which extend through spacer elements 20 and engage first 22 and second 24 perpendicular slidebars. First 26 and second 28 adjustable table side clamps are positioned on adjustable table brackets 14 and 16 respectively. Clamps 26 and 28 are operable by handles 27 and 29 respectively to adjust the height of slidebar support 12 above operating table 2.

First 30 and second 32 two-way adjustable support clamps are mounted on perpendicular slidebars 22 and 24 respectfully. The two-way adjustable support clamps are movable horizontally on the perpendicular slidebars 22 and 24 as indicated by arrows 34. First 36 and second 38 patient support brackets are engaged by and supported in two-way adjustable support clamps 30 and 32 respectively. Iliac crest, or hipbone, supports 40 and 42 are mounted on the upper ends of patient support brackets 36 and 38 respectively by suitable means such as bolts 41. The two-way adjustable support clamps 30 and 32 have adjustment handles 31 and 33, respectively, which permit the iliac crest supports 40 and 42 to be adjusted in a direction perpendicular to the slidebar support 12 as indicated by arrows 44 and in a direction parallel to slidebar support 12 as indicated by arrows 34. A pair of hooks 46 and 48 provide means for attaching sandbags 50 and 52 to iliac crest supports 40 and 42 respectfully.

Referring to FIG. 1, the patient support frame of the present invention is shown mounted on an operating table 2. The entire table is tilted in a reverse Trendelenburg position so that the patient's back is level with the operating room floor. The table is broken at the chest and shoulder area 8 to prevent too much hyper-extension of the head and neck. As illustrated, the majority of the patient's trunk of the body rests on the chest 6, which may or may not be supported at the sides with chest rolls (not shown) to prevent lateral movement. The patient's arms may be placed on arm boards (not shown). The table head rest 4 has been moved to the foot of the table as illustrated and is elevated to provide the knees with some flexion. If desired, restraining means such as a wide rubber strap (not shown) may be placed across the patient's thighs to prevent any slip in the patient's position. As illustrated, the patient support frame 10 of the present invention supports the prone (face down) patient in such a way that the abdomen does not touch the supporting table 2. The trunk of the patient's body rests on the chest, hipbones and thighs.

In the use of the patient support frame of the present invention, the frame 10 is erected on an operating table 2 as illustrated in FIG. 1, except that one of the iliac crest supports, either 36 or 38 is removed to more easily enable the patient to be positioned on the table 2 over the support frame 10. The patient is moved onto the operating table in a prone or face down position. Sandbags or other materials may be temporarily placed across the support frame to prevent injury to the patient. After the patient is prone on the operating table, the removed iliac crest is replaced on the frame. Then the two iliac crest supports are moved as indicated by arrows 34 and 44 to adjust the point of contact at the patient's iliac crests and sandbags 50 and 52 on iliac crest supports 40 and 42 so that the patient's abdomen is supported off the table as indicated. Sandbags 50 and 52 are placed on the iliac crest supports 40 and 42 before the placement and positioning of the patient in order to conform the iliac crest support surface to the contour of the patient's hipbone area in such a way as to avoid the creation of pressure on the abdomen and to avoid creation of a pressure sore. Finally, the adbominal area is checked to varify that it does not contact the table and the sandbags 50 and 52 are rotated so that they do not produce indentations in the abdomen.

Prior to the present patient support frame invention, when a laminectomy procedure, particularly a posterior lumbar interbody fusion, was performed a great deal of epidural vein exposure occurred resulting in substantial bleeding, particularly in larger patients. Use of the present patient support frame invention in laminectomy procedures results in the elimination of pressure in the abdominal area and, consequently, the epidural veins which often are quite a troublesome source of bleeding was remarkedly reduced in size, resulting in the elimination or substantial reduction of bleeding. The elimination of bleeding allows the procedure to be carried out with much more ease and freedom.

It can thus be seen that the patient support frame according to the present invention is advantageous in several different respects. First, the support frame is advantageous in that it can be secured to a conventional operating table 2 thus obtaining the advantages of the invention without the necessity to modify existing operating room equipment. An additional advantage of the present invention is that the frame is simple in design, lightweight and portable. The invention takes approximately three minutes to assemble on a conventional operating table. Furthermore, although inexpensive in constrution, the patient support frame of the present invention is most efficient and effective in eliminating or substantially reducing patient bleeding during laminectomy procedures. A still further advantage of the patient support frame according to the present invention is that the frame is portable and can be moved from one table to another. A further advantage of the patient support frame with the present invention is that the apparatus has only two movable parts which are adjustable to accommodate an infinite number of patient sizes and shapes.

While one embodiment of my invention has been described herein, still further modifications will be apparent to those skilled in the art to which it pertains without deviation from the spirit of the invention as defined by the scope of the appended claims.

I claim:

1. An attachment for a surgical table comprising:

first and second adjustable table brackets having first and second table clamps thereon respectively for attachment to an operating table;

a slidebar support attached to said adjustable table brackets;

first and second perpendicular slidebar members attach to said sidebar support;

first and second two-way adjustable support clamps attach to said first and second perpendicular slidebars;

first and second patient support brackets engaged in said two-way adjustable support clamps respectively;

iliac crest supports mounted at the ends of said patient support brackets.

2. A portable patient support frame for use with surgical tables during posterior lumbar laminectomy operations comprising:

left and right side clamp means adapted for releasable attachment to the left and right side of said table;

left and right side table brackets adjustably positioned within said left and right side clamp means;

a slidebar support member attached to said adjustable table brackets;

left and right side perpendicular slidebar members separated from and fixedly attached to said slidebar support member;

left and right side two-way adjustable support clamps mounted on said left and right side perpendicular slidebar members;

left and right side patient support brackets mounted on said left and right side two-way adjustable support clamps;

left and right side patient support pads mounted on said left and right side patient support brackets.

* * * * *